US005541361A

United States Patent [19]

Friesen et al.

[11] Patent Number: 5,541,361

[45] Date of Patent: Jul. 30, 1996

[54] INDOOR COMMUNICATION CABLE

[75] Inventors: Harold W. Friesen, Dunwoody; Philip N. Gardner, Suwanee, both of Ga.; Thomas M. Wolterman, Omaha, Nebr.

[73] Assignee: AT&T Corp., Murray Hill, N.J.

[21] Appl. No.: 359,682

[22] Filed: Dec. 20, 1994

[51] Int. Cl.[6] ..... H01B 11/02

[52] U.S. Cl. ..... 174/34; 174/121 A; 174/107; 174/36

[58] Field of Search ..... 174/36, 121 A, 174/115, 34, 107

[56] References Cited

U.S. PATENT DOCUMENTS

| | | | |
|---|---|---|---|
| Re. 31,277 | 6/1983 | Gabriel et al. | 174/36 |
| 2,849,526 | 8/1958 | Brockbank | 174/107 |
| 3,031,524 | 4/1962 | Hicks | 174/112 |
| 3,692,924 | 9/1972 | Nye | 174/120 SR |
| 4,058,669 | 11/1977 | Nutt et al. | 174/34 |
| 4,085,284 | 4/1978 | Olszewski et al. | 174/36 |
| 4,096,346 | 6/1978 | Stine et al. | 174/36 |
| 4,262,164 | 4/1981 | Nutt et al. | 174/34 |
| 4,340,771 | 7/1982 | Watts | 174/36 |
| 4,401,845 | 8/1983 | Odhner et al. | 174/113 R |
| 4,453,031 | 6/1984 | Justiss | 174/36 |
| 4,482,413 | 11/1984 | Bahannon, Jr. et al. | 156/54 |
| 4,605,818 | 8/1986 | Arroyo et al. | 174/107 |
| 4,755,629 | 7/1988 | Beggs et al. | 174/34 |
| 4,913,517 | 4/1990 | Arroyo | 350/96.23 |
| 4,941,729 | 7/1990 | Hardin et al. | 350/96.23 |
| 5,039,195 | 8/1991 | Jenkins et al. | 385/101 |
| 5,043,539 | 8/1991 | Connole et al. | 174/107 |
| 5,133,034 | 7/1992 | Arroyo et al. | 385/107 |
| 5,216,202 | 6/1993 | Yoshida et al. | 174/36 |

*Primary Examiner*—Kristine L. Kincaid
*Assistant Examiner*—Chau N. Nguyen

[57] ABSTRACT

A cable for use within customer premises that effectively extends outside plant service to within the building. The cable has first and second core assemblies preferably formed of flame resistant material completely isolated from each other and surrounded by a shielding member having a rough FIG. 8 configuration. Each of the cores is completely enclosed within the loops formed by the shielding member and completely isolated from the other core. The shielding member is surrounded by a preferably flame resistant outer jacket.

15 Claims, 1 Drawing Sheet

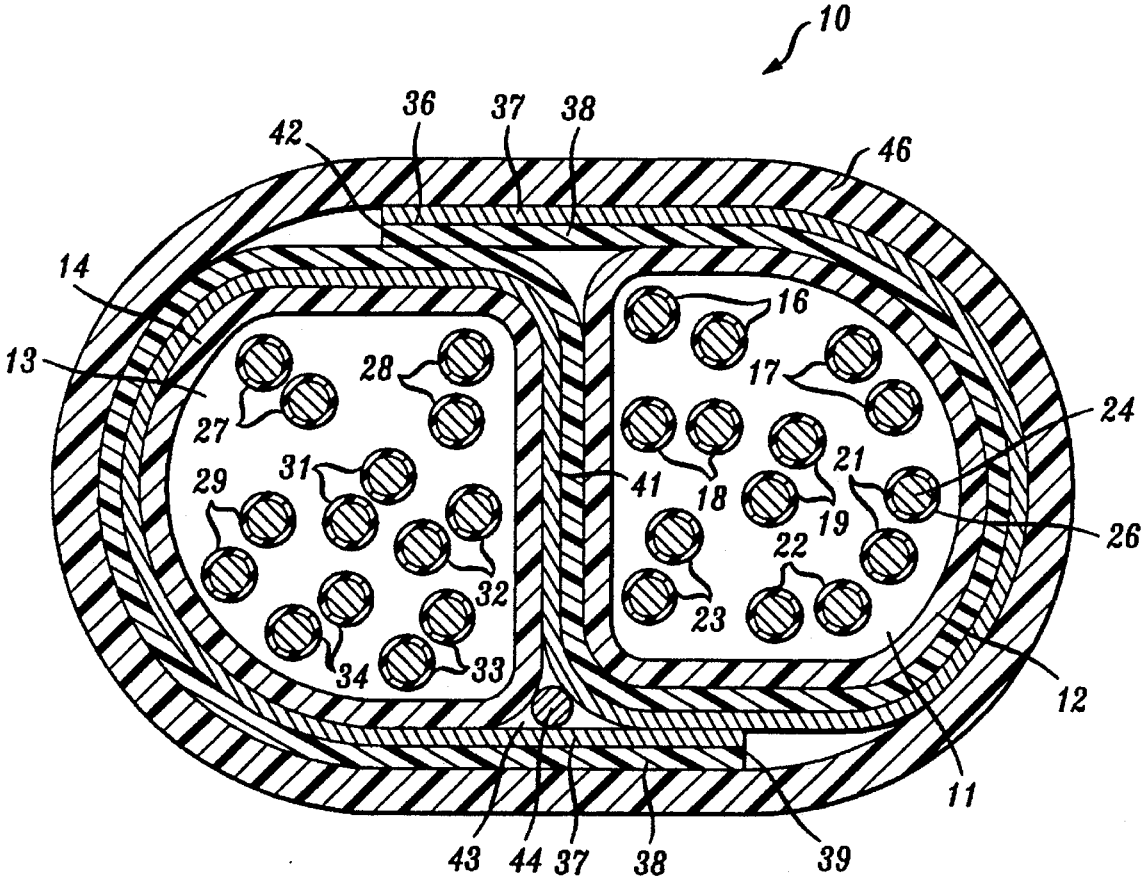
10
36
37
38
42
46
14
13
28
27
31
29
32
34
33
16
17
24
41
18
21
19
26
22
23
12
11
43
44
37
38
39

INDOOR COMMUNICATION CABLE

FIELD OF INVENTION

This invention relates to electrical communications cables and, more particularly, to a cable intended primarily for indoor use in customer premises.

BACKGROUND OF THE INVENTION

At the present time, both intercity and out-of-state communications cables utilize both carrier and voice frequency transmissions. These cables are in the form of a multipair configuration and are used primarily for connecting central offices. Local Exchange Carriers (LEC) provide digital service to customers in common carrier systems, and, in North America, these systems operate at 1.544, 3.152 and 6.312 Mb/s data rates, and are commonly known as T1, TIC, and T2 systems, respectively. The cables most often are terminated at the customer's premises at a network interface (NI), where the transition from the outside plant (OSP) cable to the inside wiring is made. In general, the inside wiring is in the form of multiple twisted pairs of metallic conductors.

A dominant carrier system such as T1 is shown and described in an article in the Bell Laboratories Record, Vol. 40, No. 10, November 1962 at pages 358–363, and a Cable for T1 carrier use is shown in U.S. Pat. No. 4,262,164 of Nutt et al. In the T1 carrier cable, each twisted pair transmits data in one direction at the carrier rate and a compliment twisted pair transmits or carries data in the opposite direction. The T1 carrier outside plant design rules limit the maximum signal loss, which translates into cable distance between regeneration to 32 dB, and to 24 dB for an end span which originates or terminates at either the central office (CO) or the customer's building, or the equivalent. This insures that, for a properly designed cable, the transmitted signals will not interfere with the received signals. The lesser allowable loss for the end span takes into account the additional noise interference encountered inside or near the building.

It is common practice to separate the pairs of transmit and receive paths into different cables, or in different compartments of a cable divided by a conductive screen, as shown in the aforementioned Nutt et al. patent, or at the very least, to separate transmit pairs and receive pairs into multiple pair binder groups. The purpose of such separation is to minimize the signal interference at the cable ends of the receiving pair from the signal in the transmitting pair by having physical separation thereof and/or an element such as a shield or a screen interposed therebetween, to absorb the disturbing noise interference. Some cable designs have multiple individually shielded twisted pairs that provide isolation between every pair. However, it is unnecessary to shield every circuit or pair in the same signal direction and often these designs have impedance mismatch and increased or high attenuation making them unsuitable for most digital carrier signal transmission over significant distances.

The transition from an OSP cable to an inside wiring cable is made at the network interference (NI). It is often the case that the OSP cable is at the very limits of the aforementioned loss figure for the end span segment, or that it even exceeds these limits. Thus, further extension of the digital service beyond the NI can result in unacceptable signal-to-noise ratios leading to-transmission errors. The OSP cables often contain hundreds of pairs of conductors where a digital service to a customer's premises can often require sixteen (16) pairs or less. It is the practice to install multiple small or low pair cables which usually, however, because of their size, do not have effective binder group separation.

Many buildings typical of customers' premises have, in the interior thereof, drop ceilings that are spaced below a structural floor panel of concrete or the like. The drop ceiling supports light fixtures and other ceiling mounted hardware, and the space between the drop ceiling and the structural floor panel thereabove serves as a return-air plenum for the heating and cooling systems. In addition, this space or plenum is used for the installation and routing of communications, computer, and alarm system cables. The plenum represents a very real tire hazard in that it is, in effect, a duct having air currents therein. When a fire starts in, or reaches the plenum, it and the accompanying smoke can quickly spread throughout the entire floor or story of the building over which the plenum extends. The fire could travel along the length of the cables contained within the plenum, especially where the cable or wire insulation is flammable, such as in the case with many commonly used plastic insulators. Because of this possibility of catastrophic flame and smoke spread, the National Electric Code (NEC) prohibits the use of electrical cables within plenums unless they are enclosed in metallic conduits, and various local codes have been adopted embodying the strictures and requirements of the NEC Code. Inasmuch as metal conduits are difficult to route in plenums congested with other items or hardware, it becomes an extremely expensive proposition, both as to hardware and labor, to enclose the cables within conduits. As a consequence, there have been promulgated certain exceptions to the requirements for metal conduits in order to provide some relief from the prohibitive expense while still insuring adequate fire protection. Thus, the NEC and most local codes permit the use of flame resistant, low smoke producing cables without a metal conduit provided the cable has been tested and approved by a recognized reliable authority such as Underwriters Laboratories (UL).

What is needed and not, apparently, presently existent in the prior art, is a cable for use within the customer,s premises having characteristics that are a match, or at least do not clash, with the characteristics and parameters of T1 or other carder OSP cable; that affords an impedance match with such cable; that adequately maintains a separation between incoming signal bearing and outgoing signal bearing conductor pairs to insure, among other considerations, a low degree of cross-talk, and that is both fire retardant and low smoke producing while being less costly than most currently available cable.

DESCRIPTION OF THE INVENTION

The principles and features of the present invention are incorporated in an illustrative embodiment of the invention which comprises a compartmentalized cable having, in effect, first and second cores. Each core contains, for example, seven twisted pairs of signal conductors surrounded by an inner jacket of suitable insulating material such as flame resistant ethylene-chlorotrifluoroethylene (ECTFE). Each of the inner jackets is completely surrounded by a shielding member formed of an aluminum-polyester laminate configured in the approximate form of an S-curve with the ends of the S overlapping to produce two completely enclosed and shielded compartments. The closed loops of the S shape form an approximate Figure 8 shape, and this term will be used hereinafter in the discussion of the aluminum-mylar shield configuration. A drain or grounding wire is contained within the configuration formed by the shielding member, in contact with the metallic portion thereof, exterior of the two compartments. An outer jacket surrounds the shielding member in contact therewith, and is made of a material such as a polyvinylidine fluoride copolymer, which is flame and smoke retardant.

The cable of the invention provides directional isolation of the twisted pairs so that the T1 service can be extended beyond the NI within the buildings. The S-shaped screen or shielding member limits cross talk in the hi-directional signals of the multiple pairs to acceptable levels as well as provides total shielding of the twisted pairs to hinder EMI interference. The inner jacket of the cable which encloses the twisted pairs in each signal direction, serves as a buffer between the shield and the circuits to minimize the added signal loss of a pair being in close proximity to the shield.

The cable of the invention also functions successfully in a DS-1 (digital) network. Digital services to a customer's premises equipment often requires a small number of circuits, and the cable provides both directional isolation and total shielding of the pairs to reduce or hinder EMI interference. The cable is impedance matched with network elements to insure that the signal conforms to DS1 standards up to the maximum distance when used with digital signal interface devices.

As was discussed hereinbefore, the cables for indoor use are required to have low flame spread or low flame and low smoke emission, whereas OSP cables do not have to meet such requirements and usually are made of highly combustible materials. Thus, the desideratum of T-1 performance, for example, within the building, cannot be met by an extension of the OSP T-1 cable. The cable of the invention is made of flame resistant materials and has the added advantage of a separate flame resistant shield member surrounding and enclosing all of the conductors. Thus, the shield member performs both an electrical function and a mechanical function, i.e., flame retardation.

The numerous features and advantages of the present invention will be more readily apparent from the following derailed description read in conjunction with the accompanying drawings.

DESCRIPTION OF THE DRAWINGS

FIG. 1 is a cross-sectional end view of the cable of the invention.

DETAILED DESCRIPTION

FIG. 1 depicts a preferred embodiment of the cable 10 of the invention in cross-section. The core portion of the cable 10 comprises a first core assembly 11 formed with a jacket 12 of suitable material and a second core assembly 13 formed with a jacket 14 of suitable material. To meet the flame retardant requirements for cable intended for indoor use, the material of the jacket 12 and 14 is preferably a flame retardant material such as ethylene-chlorotrifluoroethylene (ECTFE), which is commercially available under the name Halar®. In those rare instances where the cable is not to be used as a plenum or riser cable, jackets 12 and 14 may be made of any suitable insulating material such as polyvinyl chloride (PVC). Within core assembly 11 there are contained a plurality of twisted pairs 16,16; 17,17; 18,18; 19,19; 21,21; 22,22; and 23,23 of insulated conducting wires. Each insulated wire comprises a copper or other metallic conductor 24 surrounded by an insulation layer 26. In FIG. 1 seven twisted pairs are shown. It is to be understood that more and fewer such pairs may be contained within core assembly 11, the number shown here being by way of example only. The number of pairs preferably ranges from two to sixteen but can be more than sixteen. Core assembly 13 likewise contains a plurality of twisted pairs 27,27; 28,28; 29,29; 31,31; 32,32; 33,33; and 34,34 of conductors.

Surrounding each of the core assemblies 11 and 13 and isolating them from each other is a shield member 36 comprising a laminate of thin aluminum (approximately 1 to 2 mils thickness) sheeting:37 and thin polyester, such as Mylar® (approximately 1 to 2 mils thickness) sheeting 38 bonded to the aluminum layer 37. The laminate thus formed is quite flexible, as is to be desired, yet quite strong with a minimal tendency to crack. As can be seen in FIG. 1, the shield 36 passes around core assembly 11 with the Mylar sheet 38 in contact with jacket 12, up between jackets 12 and 14, thereby isolating them from each other and around core assembly 13 with the aluminum sheeting 37 in contact with jacket 14. The end 39 of shield 36 extends beyond and transversely to the plane of the isolating portion 41 thereof which passes between and is parallel to the longitudinal axis of the two core assemblies 11 and 13 and rests against that portion of the shield which surrounds core assemblies 11, in metal-to metal contact. In like manner, the end 42 of shield 36 extends beyond and transversely to the plane of the portion 41 of the shield, and rests against that portion of shield 36 which surrounds core assembly 13, in dielectric-to-dielectric contact. Thus, as clearly seen in FIG. 1, laminated shield 36 is configured to form two closed loops in what may be described as an approximate FIG. 8 configuration, each loop completely enclosing one of the core assemblies 11 and 13 and shielding it both electrically and mechanically. The inner jackets 12 and 14, in addition to forming a containing tube for the twisted pairs, also functions as a buffer to prevent any of the conducting wires or pairs from being in too close proximity to the metallic shield, thereby minimizing signal losses resulting from electromagnetic interaction therebetween.

As can be seen in FIG. 1, a small gap 43 is formed by a straight portion and a curved portion of metallic layer 37 and a curved portion of inner jacket 14. A drain or ground wire 44 is positioned in the gap 43 and extends along the length of the cable in contact with metallic member 37 throughout the length thereof.

An outer jacket 46 completely surrounds the shield member 36,,as shown, and hence, the entire cable. Jacket 46 preferably is made of a flame retardant, low smoke producing material, for example, a poly(vinylidene fluoride) (PVDF) copolymer such as commercially available Solef®. There, the danger of fire is not a consideration, jacket 46 may be made of a suitable insulating material such as PVC. It is to be preferred, however, that both inner jackets 12 and 14 and outer jacket 46 be made of the flame retardant materials. When so constituted, and in conjunction with shield member 36, the cable of the invention meets the UL requirements for plenum cables.

The cable of the invention is impedance matched to the incoming T-1 cable (or DS1 cable) and thus, has the effect of extending T-1 service, including pair separation to reduce cross-talk, into the building. Unlike the T-1 or DS-1 cable, the cable of the invention meets the UL requirements for flame retardation indoors. The present cable replaces existing cable layouts, which generally consist of two or more separate cables, hence, it is more economical of space, easier to install and route, and, in general, less costly.

We claim:

1. A communications cable for use indoors comprising:

means defining a first core assembly that has at least one twisted pair of conductors therein;

means defining a second core assembly that has at least one twisted pair of conductors therein;

said first and second core assemblies being adjacent to and spaced from each other to define a transverse space;

a continuous shielding means completely surrounding each of said first and second core assemblies and having a portion thereof extending through said transverse space;

a jacket member surrounding and enclosing said shielding means and said core assemblies; and wherein at least one of said means defining a first core assembly and said means defining a second core assembly comprises a flame retardant plastic jacket.

2. A communication cable as claimed in claim 1 wherein the material of said plastic jacket is ethylene-chlorotrifluoroethylene.

3. A communication cable as claimed in claim 1 wherein said jacket member is made of a flame retardant material.

4. A communication cable as claimed in claim 3 wherein said flame retardant material is a poly(vinylidene fluoride) co-polymer.

5. A communication cable as claimed in claim 1 wherein said shielding means comprises a thin metallic sheet having first and second ends wound about said first core assembly and said second core assembly with said portion being interposed between said first core assembly and said second core assembly in a plane parallel to the axes of said core assemblies, with each of said first and second ends extending past the transverse plane of said portion to completely enclose and isolate said core assemblies from each other.

6. A communication cable as claimed in claim 5 wherein said shielding means comprises a laminated sheet of a thin metallic material and a thin plastic material.

7. A communication cable as claimed in claim 6 Wherein said thin metallic material is aluminum.

8. A communication cable as claimed in claim 5 and further comprising a grounding member enclosed within said jacket member and in conductive contact with metallic portions of said shielding means.

9. A communication cable as claimed in claim 6 wherein said thin plastic material is polyethylene terephthalate.

10. A communication cable for use indoors, comprising:

a flame retardant plastic jacket defining a first core assembly that has at least one twisted pair of conductors therein;

a flame retardant plastic jacket defining a second core assembly that has at least one twisted pair of conductors therein;

said first and second core assemblies being adjacent to and spaced from each other to define a transverse space;

a continuous shielding means completely surrounding each of said first and second core assemblies and having a portion thereof extending through said transverse space; and a jacket member surrounding and enclosing said shielding means and said core assemblies.

11. A communication cable as claimed in claim 10, wherein the material of said plastic jackets defining said first and second core assemblies is ethylene-chlorotrifluoroethylene.

12. A communication cable as claimed in claim 10, wherein said jacket member is made of a flame retardant material.

13. A communication cable for use indoors, comprising:

flame retardant material defining a first core assembly that has at least one twisted pair of conductors therein;

flame retardant material defining a second core assembly that has at least one twisted pair of conductors therein;

said first and second core assemblies being adjacent to and spaced from each other to define a transverse space;

a continuous shielding means completely surrounding each of said first and second core assemblies and having a portion thereof extending through said transverse space;

a jacket member comprised of flame retardant material surrounding and enclosing said shielding means and said core assemblies.

14. A communication cable as claimed in claim 13 wherein said flame retardant material of defining each of said core assemblies is ethylene-chlorotrifluoroethylene.

15. A communication cable as claimed as claim 13 wherein said flame retardant material defining each of said core assemblies is ethylene chlorotrifluoroethylene.

* * * * *